United States Patent [19]

Baugh et al.

[11] 4,296,718

[45] Oct. 27, 1981

[54] DIESEL ENGINE SHUTDOWN CONTROL SYSTEM

[75] Inventors: Edward D. Baugh; Mark B. Hoffman, both of Union Lake, Mich.

[73] Assignee: General Motors Corporation, Detroit, Mich.

[21] Appl. No.: 75,954

[22] Filed: Sep. 17, 1979

[51] Int. Cl.[3] ..... F02M 63/02

[52] U.S. Cl. ..... 123/198 D; 123/198 DB; 123/387; 123/DIG. 11

[58] Field of Search ..... 123/198 DB, 198 D, 397, 123/367, 373, 387, 388, 529, DIG. 11, 452, 514

[56] References Cited

U.S. PATENT DOCUMENTS

| | | | |
|---|---|---|---|
| 835,759 | 11/1906 | Kellett | 123/198 DB |
| 891,368 | 6/1908 | Potter | 123/198 DB |
| 1,195,764 | 8/1916 | Arqueboorg | 123/514 |
| 2,010,420 | 8/1935 | Simmen | 123/387 |
| 2,499,319 | 2/1950 | Lillquist | 123/198 DB |
| 3,153,405 | 10/1964 | Paterson | 123/179 L |

FOREIGN PATENT DOCUMENTS

| | | | |
|---|---|---|---|
| 1299678 | 12/1972 | United Kingdom | 123/198 DB |

*Primary Examiner*—Charles J. Myhre
*Assistant Examiner*—Carl Stuart Miller
*Attorney, Agent, or Firm*—Robert J. Outland

[57] ABSTRACT

A diesel engine fuel supply and control system for an engine having a fuel supply pump which has its direction of rotation in accord with the direction of engine rotation is provided with engine shutdown, anti-bump start and reverse rotation arresting means including, in a preferred embodiment, a pressure responsive piston that acts against a run-stop control lever to cut off fuel supply to the engine cylinders and a selector valve that selectively exposes the piston to pressures on either side of the engine fuel pump. When the valve is set to provide the normal pump inlet pressure to the piston, the engine may operate in the forward rotation direction but is stopped if reverse rotation occurs. If changed to expose the piston to normal pump outlet pressure, the engine is stopped or prevented from operating in the forward rotation direction. A check valve is preferably provided to prevent loss of pressure acting on the piston to the pump outlet so that maximum pressure is maintained to assure a full normal stop and provide subsequent protection against bump starting of the engine in a vehicle.

4 Claims, 1 Drawing Figure

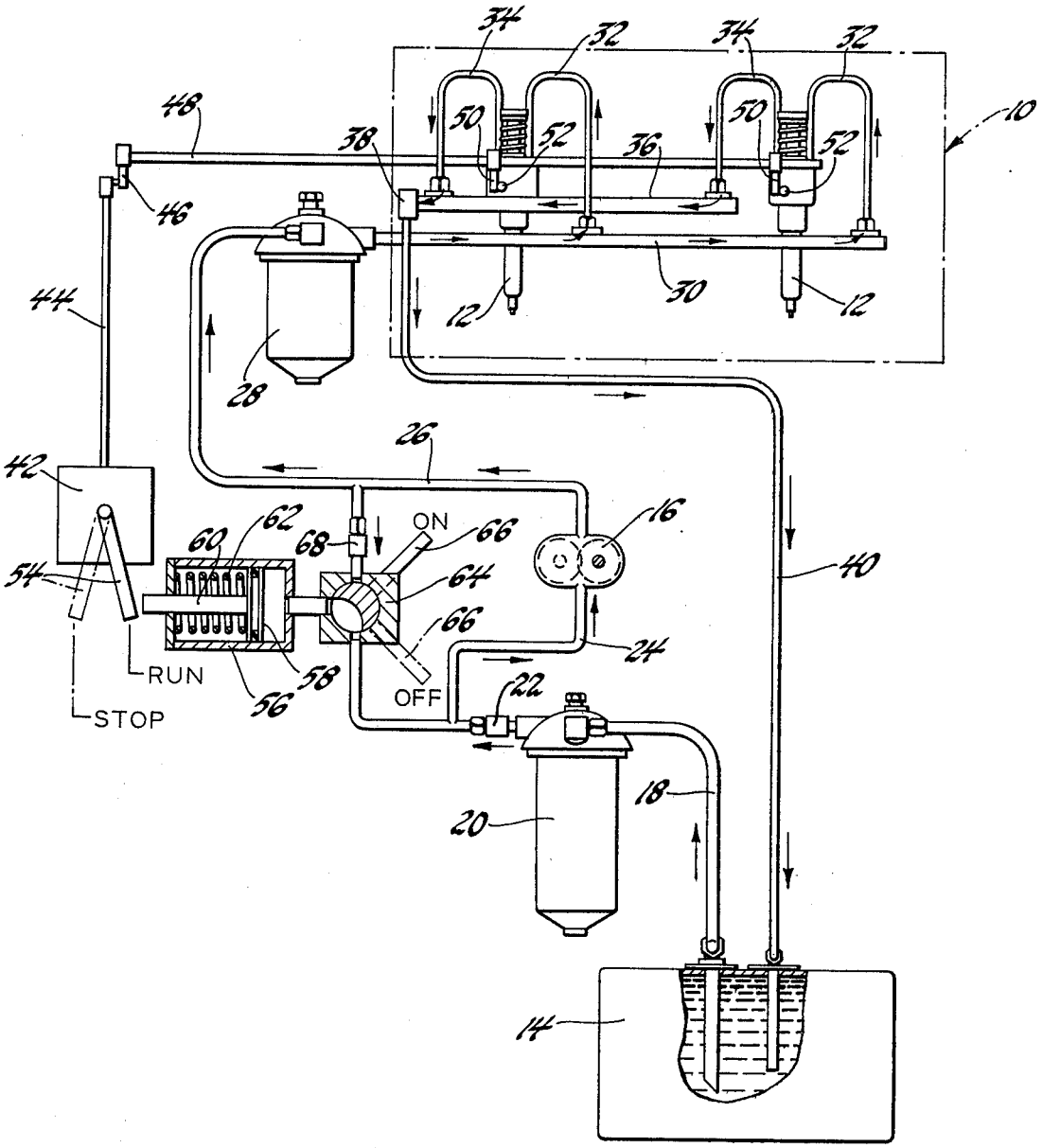
34
32
34
32
10
48
38
50
52
36
50
52
46
44
30
12
12
28
26
42
16
ON
66
60
62
68
64
40
54
66
24
RUN
58
56
OFF
22
STOP
18
20
14

DIESEL ENGINE SHUTDOWN CONTROL SYSTEM

TECHNICAL FIELD

This invention relates to diesel engines and more particularly to systems for normal shutdown, arrest of abnormal reverse rotation and avoidance of bump starting for engines in which the fuel pump is engine driven or operates in a direction determined by the direction of engine rotation.

BACKGROUND OF THE INVENTION

It is known in the diesel engine art to provide a fuel injection system wherein an engine driven pump supplies fuel at a relatively low pressure to injectors or injection pumps, with an excess capacity of non-injected fuel being returned through a return line to the supply tank. It is usual also to provide means to control the amount of fuel injected by the fuel injectors or pumps. Such means may include an engine mounted governor or other control device having a run-stop control lever or other mechanism movable to run and stop positions to respectively permit or prevent the injection of fuel and consequently allow or stop operation of the engine.

Under some circumstances, it has been found that some engines of the type described may be inadvertently caused to operate in a reverse direction of rotation or started by bumping of a vehicle in which such an engine is installed which has been parked in gear. It is desired to provide a unified system, controllable by an operator, to stop operation of the engine when desired and also to provide protection against unintentional bump starting and inadvertent operation of the engine in a reverse direction of rotation.

SUMMARY OF THE INVENTION

The present invention provides a diesel engine shutdown control system for use with an engine of the type described.

It is a feature of the invention that pressure responsive means may be connected with the fuel pump conduit in which pressure is developed by reverse engine rotation to operate shutoff means which preclude fuel delivery to the engine and thereby arrest or prevent its unintended operation in a reverse direction of rotation.

A further feature of the invention is that an operator actuated selector valve may be provided to alternatively connect the pressure responsive means with either of the pump connected conduits so that the operator may set the device for normal operation or, alternatively, to a stop position which directs normal fuel pump output pressure to the shutoff means, thereby providing a normal engine shutdown.

Another feature is that a one-way (check) valve may be provided to prevent the leakoff of pressure from the pressure responsive means when the selector valve is in the off position to insure a complete stop of the engine and to prevent inadvertent bump starting after shutdown.

These and other features of the invention will be more fully understood from the following description of a preferred embodiment taken together with the accompanying drawing.

BRIEF DESCRIPTION OF THE DRAWING

The single FIGURE of the drawing is a schematic view of a diesel engine fuel supply and control system having means to provide normal shutdown, as well as prevention of bump starting or reverse engine rotation all in accordance with the present invention.

BEST MODE FOR CARRYING OUT THE INVENTION

In the drawing, numeral 10 generally indicates an internal combustion engine of the diesel type having a fuel supply and control system and including a plurality of cylinders not shown. An injector 12 is associated with each cylinder and adapted to periodically spray a charge of fuel thereinto as permitted by the fuel supply and control system.

The fuel supply system includes a fuel supply tank 14 connected to supply fuel to a fuel pump 16 through suction line 18, fuel strainer 20, check valve 22, and pump inlet line 24. The fuel pump 16 is preferably directly driven by the engine so that, in the forward direction of engine rotation, the pump draws in fuel from the supply tank and pumps it under moderate pressure to the fuel injectors through pump outlet line 26, fuel filter 28, fuel inlet manifold 30 and injector inlet lines 32.

Fuel delivered to the injectors in excess of the volume required for injection into the cylinders is returned to the supply tank through injector outlet lines 34, fuel outlet manifold 36, low pressure relief valve 38 (or an optional bleed orifice) and a fuel return line 40.

Control of the amount of fuel delivered to the cylinders during operation of the engine and injectors is determined by a fuel control system. This system includes a governor 42 which acts through link 44 and lever 46 to rotate an injector control shaft 48. Shaft 48 in turn drives individual levers 50 which connect with the control racks 52 of the injectors. The control rack position determines the amount of fuel injected.

The operation of the governor 42 may be in part controlled by the engine or vehicle operator through known mechanism not shown and it is further controlled by a run-stop control lever 54 which is movable between "run" and "stop" positions indicated respectively by solid and broken lines in the drawing. Placing the lever 54 in the "run" position allows the governor to permit normal engine operation, while moving the lever to the "stop" position causes the governor to set the fuel control system so as to cut off the delivery of fuel by the injectors to the engine and thus prevent operation of the engine.

To the above described previously known features of a diesel engine fuel supply and control system, the present invention adds shutdown control means arranged to provide added functions of remotely controlled normal shutdown with prevention of bump starting and arrest of reverse engine rotation. The shutdown control system includes pressure responsive means in the form of a hydraulic cylinder 56 having therein a piston 58 attached to an actuating rod 60 which is engagable with the run-stop control lever 54 of the governor. A spring 62 biases the piston and rod in a direction away from engagement with the control lever.

The shutdown control system further includes a three-way selector valve 64 connecting with the hydraulic cylinder 56 and with both the inlet line 24 and the outlet line 26 of the fuel pump 16. Valve 64 is controlled by a handle 66 or other suitable operating mechanism which may be actuated by a vehicle operator so as to move the valve into either an "on" position indicated in solid lines or an "off" position indicated in broken lines on the drawing. A check valve 68 is provided between the valve 64 and the fuel pump outlet line 26 to allow only one-way flow from the line to the valve.

OPERATION OF THE ILLUSTRATED EMBODIMENT

In operation of the system described, when the handle 66 of the three-way selector valve 64 is placed in the "on" position as illustrated in the drawing, the hydraulic cylinder 56 is connected to the inlet line 24 of the fuel pump. When the engine is operating in the normal forward direction of operation, there is no positive pressure in line 24, but rather a small vacuum is created which is transmitted to the hydraulic cylinder 56. Thus the spring 62 is able to move the piston 58 in the cylinder 56 to a position such that the governor operating lever 54 may remain in the normal run position as shown, permitting the engine to operate in the normal manner.

Should some operating condition occur which causes the direction of engine rotation to reverse, the engine driven fuel pump will also reverse its operating direction. The check valve 22 will prevent the reverse flow of fuel from the pump back to the tank 14, thus causing pressure to develop in the inlet line 24, which has now become an outlet line for the fuel pump. In this circumstance, the pressure developed in the line 24 is fed directly to the hydraulic cylinder 56, urging the piston 58 against the bias of spring 62 into engagement with the governor run-stop control lever 54 and moving the lever to its "stop" position as shown in phantom lines in the drawing. This action causes the governor to move the control linkage to shut off the injection of fuel to the engine cylinders by the fuel injectors, thus arresting continued operation of the engine in a reverse direction.

Assuming, however, that the engine continues to operate normally while the selector valve 64 is in the "on" position shown, the operator may utilize, this same selector valve to stop the engine in a normal manner by moving the valve handle 66 to its "off" position. This movement cuts off the connection of the hydraulic cylinder 56 with the pump inlet line and connects it through check valve 68 with the pump outlet line 26 so that the normal fuel outlet pressure from the pump is supplied to the hydraulic cylinder 56. This pressure then acts against the piston 58, urging it against the governor run-stop control lever 54 and moving the lever to its "stop" position, thereby cutting off the injection of fuel to the engine and arresting further operation.

As the engine speed slows down and pressure in the pump outlet line is reduced during a normal shutdown, the check valve 68 prevents the return flow of fuel from the cylinder 56 to the outlet line 26. Thus, the maximum fuel pressure is retained in the cylinder, holding the governor control lever firmly in the stop position and assuring a full stop of the engine. Subsequently, the continued maintenance of pressure in the cylinder by the check valve prevents the engine from being restarted inadvertently, through bump starting. It should be noted that some of the above functions could be adequately provided without use of the check valve 68. For example, if pressure relief valve 38 is used which has the capability of completely stopping flow below the preset control pressure, the remaining system pressure may be adequate to hold in the piston 58 for a complete stop and the subsequent prevention of bump starting.

Thereafter normal operation of the engine may be resumed only by again moving the valve handle 66 back to its "on" position and resetting, if necessary, the governor control lever 54 to the "run" position. Resetting of the governor operating lever is usually accomplished automatically through suitable means associated with the governor upon restoring of the valve handle to the "on" position.

Installation of a system of the type described in conjunction with a vehicle mounted diesel engine provides the previously mentioned advantages of operator controlled normal shutdown as well as prevention of bump starting and arresting of undesired operation of the engine in a reverse direction of rotation.

While the invention has been described by reference to a specific embodiment it should be recognized that numerous modifications and changes could be made in the various elements or features of the described embodiment without departing from the inventive concepts disclosed. Accordingly it is intended that the invention not be limited to the embodiment disclosed or to the alternatives suggested but that it have the full scope permitted by the language of the following claims.

The embodiments of the invention in which an exclusive property or privilege is claimed are defined as follows:

1. A diesel engine fuel supply and shutdown control system comprising fuel injection means to inject fuel into the engine combustion chambers, a control lever movable into "stop" and "run" positions to respectively prevent or permit fuel injection to the combustion chambers, an engine driven fuel pump capable of generating pressure in either direction of rotation and connected to supply fuel to the fuel injection means from a source of supply, a check valve to prevent reverse fuel flow from the fuel pump to the supply source and shutdown means including a pressure actuator operatively engaging said control lever and responsive to fuel pump pressure to move said lever to its stop position, said actuator being biased toward a nonoperative position that permits location of said lever in its run position, first and second conduit means connecting said actuator with opposite sides of said fuel pump to supply pressure therefrom in either direction of pump operation and selector valve means connected in said first and second conduit means and movable into "on" and "off" positions to control engine operation, said selector valve means being operative in the "on" position to shut off the first conduit from the engine side of the pump and open the second conduit from the supply side of the pump to permit normal engine operation but prevent reverse operation and said selector valve means being operative in the "off" position to shut off the second conduit from the supply side of the pump and open the first conduit from the engine side of the pump to supply pump pressure to the actuator during normal operation and thereby shut down the engine.

2. The combination of claim 1 and further comprising one-way valve means in the first conduit means between said selector valve and the engine side of the pump and arranged to permit fuel to flow from the pump outlet to the actuator and to prevent flow in the reverse direction, whereby high fuel pressure formed in the actuator at normal shutdown is maintained therein to assure a positive stop and provide subsequent protection against bump starting of the engine while the selector valve remains in the "off" position.

3. A diesel engine shutdown and reverse rotation arresting apparatus for use with an engine having a fuel supply pump which has its direction of rotation in accord with the direction of engine rotation and connects with two conduits in either one of which discharge pressure is developed depending upon the direction of pump rotation, said apparatus comprising pressure responsive means operative when connected to a pressure source to sense the development of pressure therein, shutoff means operatively connected with and responsive to said pressure responsive means to preclude fuel delivery to said engine upon development of pressure in said pressure responsive means, and selector valve means operative in alternative valve positions to connect said pressure responsive means with one or the other of said conduits, whereby in one valve position said apparatus stops or precludes forward rotation engine operation while in the other valve position said apparatus stops or precludes reverse rotation engine operation.

4. The combination of claim 3 wherein said pressure responsive means is a hydraulic piston reciprocable in a cylinder and said shutoff means is a control element for a governor that controls fuel input to said diesel engine.

* * * * *